US012036599B2

(12) United States Patent
Sato et al.

(10) Patent No.: US 12,036,599 B2
(45) Date of Patent: Jul. 16, 2024

(54) PRESS BRAKE

(71) Applicant: AMADA CO., LTD., Kanagawa (JP)

(72) Inventors: Masaaki Sato, Kanagawa (JP); Shiro Hayashi, Kanagawa (JP)

(73) Assignee: AMADA CO., LTD., Kanagawa (JP)

( * ) Notice: Subject to any disclaimer, the term of this patent is extended or adjusted under 35 U.S.C. 154(b) by 360 days.

(21) Appl. No.: 17/608,624

(22) PCT Filed: Apr. 27, 2020

(86) PCT No.: PCT/JP2020/017895
§ 371 (c)(1),
(2) Date: Nov. 3, 2021

(87) PCT Pub. No.: WO2020/226084
PCT Pub. Date: Nov. 12, 2020

(65) Prior Publication Data

US 2022/0226876 A1 Jul. 21, 2022

(30) Foreign Application Priority Data

May 7, 2019 (JP) ..... 2019-087437
Apr. 13, 2020 (JP) ..... 2020-071715

(51) Int. Cl.
*B21D 5/02* (2006.01)
*B21D 37/14* (2006.01)

(52) U.S. Cl.
CPC ..... *B21D 5/0236* (2013.01); *B21D 5/0254* (2013.01); *B21D 37/14* (2013.01)

(58) Field of Classification Search
CPC ..... B21D 5/02; B21D 5/0209; B21D 5/0236; B21D 5/0254; B21D 5/0218; B21D 37/14
(Continued)

(56) References Cited

U.S. PATENT DOCUMENTS 4,509,357 A * 4/1985 Zbornik ..... B21D 5/0209 72/477
7,168,286 B1 1/2007 Pelech
(Continued)

FOREIGN PATENT DOCUMENTS

CN 101081478 A 12/2007
CN 105992658 A 10/2016
(Continued)

OTHER PUBLICATIONS

JP 2005-74429A, Aoki Aug. 2003.*
(Continued)

*Primary Examiner* — Edward T Tolan
(74) *Attorney, Agent, or Firm* — Renner, Otto, Boisselle & Sklar, LLP

(57) ABSTRACT

An attachment base extending in a left-right direction is provided on a lower end side of a front surface of an upper table of a press brake. On the attachment base, a plurality of protruding tabs protruding downward are formed at intervals in the left-right direction. An upper tool holder is disposed between the protruding tabs adjacent to each other in the left-right direction in the front surface of the attachment base. A connecting member is attached to a back surface of each protruding tab, and the connecting member includes a distal end located on a back side of the upper table. A guide member supporting a moving body movably in the left-right direction is coupled to a distal-end face of the connecting member.

7 Claims, 13 Drawing Sheets

(58) Field of Classification Search
USPC ..... 72/389.3
See application file for complete search history.

(56) References Cited

U.S. PATENT DOCUMENTS

| | | | | |
|---|---|---|---|---|
| 7,632,224 | B2 | 12/2009 | Rouweler et al. | |
| 10,500,623 | B2 | 12/2019 | Meneghetti | |
| 2002/0023477 | A1* | 2/2002 | Gianelli | B21D 5/0209 72/481.2 |
| 2003/0064871 | A1 | 4/2003 | Akami | |
| 2003/0069114 | A1 | 4/2003 | Akami | |
| 2003/0092547 | A1 | 5/2003 | Akami | |
| 2004/0157715 | A1 | 8/2004 | Akami | |
| 2007/0271987 | A1 | 11/2007 | Shimizu et al. | |
| 2007/0297889 | A1 | 12/2007 | Rouweler et al. | |
| 2014/0326036 | A1 | 11/2014 | Hayashi | |
| 2015/0174633 | A1 | 6/2015 | Sato | |
| 2016/0354821 | A1 | 12/2016 | Meneghetti | |
| 2017/0232493 | A1 | 8/2017 | Denkmeier | |
| 2017/0239701 | A1 | 8/2017 | Denkmeier | |
| 2017/0297073 | A1 | 10/2017 | Sato | |
| 2018/0236518 | A1 | 8/2018 | Sato | |
| 2020/0114407 | A1* | 4/2020 | Fabris | B21D 5/0254 |

FOREIGN PATENT DOCUMENTS

| | | | |
|---|---|---|---|
| CN | 106734644 | A | 5/2017 |
| DE | 10060405 | B4 | 3/2007 |
| EP | 1160024 | A1 | 12/2001 |
| EP | 1862255 | A1 | 12/2007 |
| JP | S58-76326 | U | 5/1983 |
| JP | H6-234018 | | 8/1994 |
| JP | H09-220618 | A | 8/1997 |
| JP | 10-211521 | A | 8/1998 |
| JP | 10-263708 | A | 10/1998 |
| JP | H11-010235 | | 1/1999 |
| JP | 2000071028 | A | 3/2000 |
| JP | 2003-71519 | | 3/2003 |
| JP | 2004-337950 | A | 12/2004 |
| JP | 2004-344918 | | 12/2004 |
| JP | 2006000855 | A | 1/2006 |
| JP | 2006-346707 | | 12/2006 |
| JP | 4672868 | B2 | 1/2011 |
| JP | 2013-111610 | A | 6/2013 |
| JP | 2014-004604 | | 1/2014 |
| JP | 2014-091137 | | 5/2014 |
| JP | 2015-120185 | | 7/2015 |
| JP | 5841800 | B2 | 1/2016 |
| JP | 6947861 | B2 | 7/2016 |
| JP | 2017-508623 | | 3/2017 |
| WO | 2008/050458 | A1 | 5/2008 |
| WO | 2015118505 | A3 | 8/2015 |
| WO | 2016/023057 | A1 | 2/2016 |
| WO | 2016/054668 | A1 | 4/2016 |
| WO | 2017/212386 | A1 | 12/2017 |
| WO | 2018/065965 | A1 | 4/2018 |

OTHER PUBLICATIONS

International Search Report for corresponding Application No. PCT/JP2020/017895, mailed Jul. 7, 2020.
Written Opinion for corresponding Application No. PCT/JP2020/017895, mailed Jul. 7, 2020.
Official Action issued in the counterpart Japanese Application No. 2020-071715, mailed Jul. 7, 2020.
Search Report issued in the counterpart EP Application No. 19837570.1, dated Aug. 12, 2021.
Search Report issued in the counterpart EP Application No. 19837688.1, dated Aug. 2, 2021.
Search Report issued in the counterpart EP Application No. 19838694.8, dated Aug. 6, 2021.
Search Report issued in the counterpart EP Application No. 19838058.6, dated Aug. 6, 2021.
European Search Report for corresponding Application No. 20805835.4, mailed May 30, 2022.
European Search Report for corresponding Application No. 20802239.2, mailed May 23, 2022.

* cited by examiner

PRESS BRAKE

TECHNICAL FIELD

The present invention relates to a press brake that bends a plate-shaped workpiece by cooperation of an upper tool and a lower tool.

BACKGROUND ART

Patent Literature 1 discloses a press brake equipped with an auto tool changer (ATC). In the press brake, an upper tool changing unit that automatically changes an upper tool is attached to a back side of an upper table. In this case, a modular type upper tool holder including the upper tool changing unit mounted thereto and extending in a left-right direction is often provided in a lower end portion (lower end side) of the upper table. In the modular type upper tool holder, a guide member supporting the upper tool changing unit movably in the left-right direction is provided on a back side of the upper table. The guide member extends in the left-right direction. The guide member is provided directly in the modular type upper tool holder, and hence parallelism of the guide member to the modular type upper tool holder can be kept with high accuracy.

On the other hand, in many of stand-alone press brakes each of which is not equipped with the ATC, a plurality of fixture plates are arranged at intervals in the left-right direction on a front surface of the upper table. On the lower end side of the upper table, a plurality of general-purpose upper tool holder referred to as distance-piece type holders are arranged at intervals in the left-right direction. Each general-purpose upper tool holder includes an attachment plate to be pressed onto the front surface of the upper table with the fixture plates. That is, on the lower end side of the front surface (front lower end portion) of the upper table, general-purpose upper tool holders are arranged at intervals in the left-right direction via the fixture plates.

To avoid interference of a side flange with a part (upper tool holder or the like) of the press brake due to folding-up of a workpiece during bending of the workpiece, an escape space is formed between the upper tool holders adjacent to each other. The side flange is a flange of the workpiece that is bent on one side or both sides in the left-right direction. Further, the general-purpose upper tool holder is usually disposed at a position adjustable in the left-right direction relative to the upper table so that the interference of the side flange with the part of the press brake can be avoided even when the side flange is disposed at an arbitrary position in the left-right direction relative to the upper table. As patent literatures related to background art, there are also Patent Literatures 2 to 6 as follows.

CITATION LIST

Patent Literature

Patent Literature 1: Japanese Patent Publication No. 4672868

Patent Literature 2: Japanese Patent Publication No. 5841800

Patent Literature 3: Japanese Patent Publication No. 5947861

Patent Literature 4: Japanese Patent Application Laid-Open Publication No. 2003-71519

Patent Literature 5: Japanese Patent Application Laid-Open Publication No. 2015-120185

Patent Literature 6: Japanese Patent Application Laid-Open Publication No. 2004-344918

SUMMARY

In recent years, it has been desired that a stand-alone press brake is equipped with ATC. In a case where an upper tool changing unit is to be disposed on a back side of an upper table in the stand-alone press brake, a guide member cannot be attached directly to an upper tool holder due to space constraints. Also, there is a concern that the upper tool holder interferes with the upper tool changing unit, and hence it is also difficult to attach the guide member directly to a back surface of the upper table. Consequently, it is presumed that a plurality of connecting members are arranged at intervals in a left-right direction on a lower end side of the back surface of the upper table, and that guide members extending in the left-right direction are integrally coupled to distal-end faces of the plurality of connecting members.

In this case, an attachment reference surface of the upper tool holder in a front-rear direction is a machining-finished surface of the upper table on a front lower end side. An attachment surface of the guide member is a distal-end face of each connecting member, and an attachment reference surface of the guide member in the front-rear direction is a machining-finished surface of the upper table on a back lower end side to which each connecting member is attached. That is, the attachment reference surface of the upper tool holder is different from the attachment reference surface of the guide member. Consequently, in a case of equipping the stand-alone press brake with the upper tool changing unit, it is not easy to keep parallelism of the guide member to the upper tool holder with high accuracy. As a result, it is difficult to sufficiently secure reliability of a changing operation by the upper tool changing unit. This occurs similarly also in a case where a moving body other than the upper tool changing unit is supported movably in the left-right direction by the guide member on a back side of the upper table in the stand-alone press brake.

An object of the present invention is to provide a press brake in which an attachment reference surface of an upper tool holder and an attachment reference surface of a guide member can be the same.

As a first feature of the present invention, provided is a press brake including an attachment base provided on a front surface of an upper table, extending in a left-right direction, and including a plurality of protruding tabs protruding downward and formed at intervals in the left-right direction, an upper tool holder disposed between protruding tabs adjacent to each other in the left-right direction in a front surface of the attachment base, and holding an upper tool, a plurality of connecting members attached to back surfaces of the plurality of protruding tabs, respectively, and including distal ends located on a back side of the upper table, and a guide member coupled to distal-end faces of the plurality of connecting members, extending in the left-right direction, and supporting a moving body movably in the left-right direction on the back side of the upper table.

Also, due to bending load (bend pressurizing force) during bending of a workpiece, a lower surface of the upper table tends to be deflected in a concave shape, and an upper surface of a lower table tends to be deflected in a concave shape. If the deflections of the upper table and the lower table are large, side misalignment (positional shift in the left-right direction) of a general-purpose upper tool holder to the upper table is likely to occur. If the misalignment occurs, interference of a side flange with a part of the press brake and bending defect occur, and highly accurate bending cannot be stably performed. This similarly occurs not only in a press brake equipped with an ATC but also in a stand-alone press brake that is not equipped with the ATC. That is, it is required to regulate the side misalignment of the upper tool holder to the upper table.

As a second feature of the present invention, provided is a press brake including a plurality of fixture plates (fastening plates) arranged at intervals in a left-right direction on a front surface of an upper table, a plurality of upper tool holders arranged at intervals in the left-right direction on a lower end side of the upper table, including an attachment plate to be pressed onto a front side of the upper table by each fixture plate, and holding an upper tool, and a regulating member disposed on each of opposite left and right sides of each upper tool holder in the upper table, and configured to regulate side misalignment (positional shift in the left-right direction) of the upper tool holder to the upper table.

DESCRIPTION OF EMBODIMENTS

Figure 1:
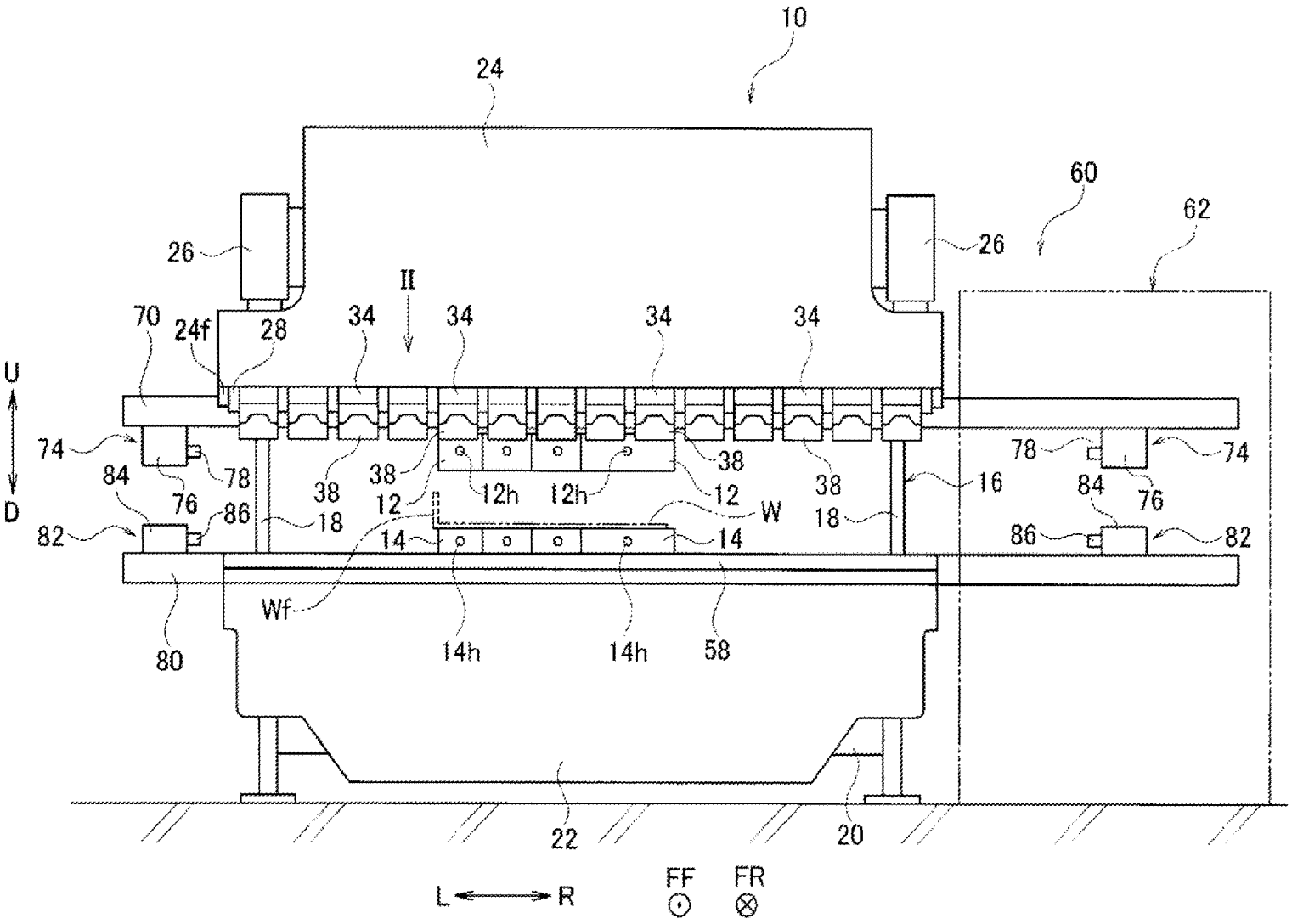
FIG. 1 is a schematic front view showing a press brake according to a first embodiment.

Embodiments (including modifications) of the present invention will be described with reference to FIG. 1 to FIG. 6.

Note that "a lateral direction" includes meanings of a lateral direction of an upper tool, a lateral direction of a lower tool, a lateral direction of an upper tool holder, and a lateral direction of a press brake unless otherwise noted. "A left-right direction" is one of horizontal directions, and is the same as the lateral direction of the press brake. "A front-rear direction" is one of the horizontal directions, and a direction orthogonal to the left-right direction. "A pressurizing center position" refers to a position of a virtual vertical plane passing through a distal end of a punch in the front-rear direction. In the drawings, "L" indicates a left direction, "R" indicates a right direction, "FF" indicates a front direction, "FR" indicates a rear direction, "U" indicates an up direction, and "D" indicates a down direction.

First Embodiment

Figure 2:
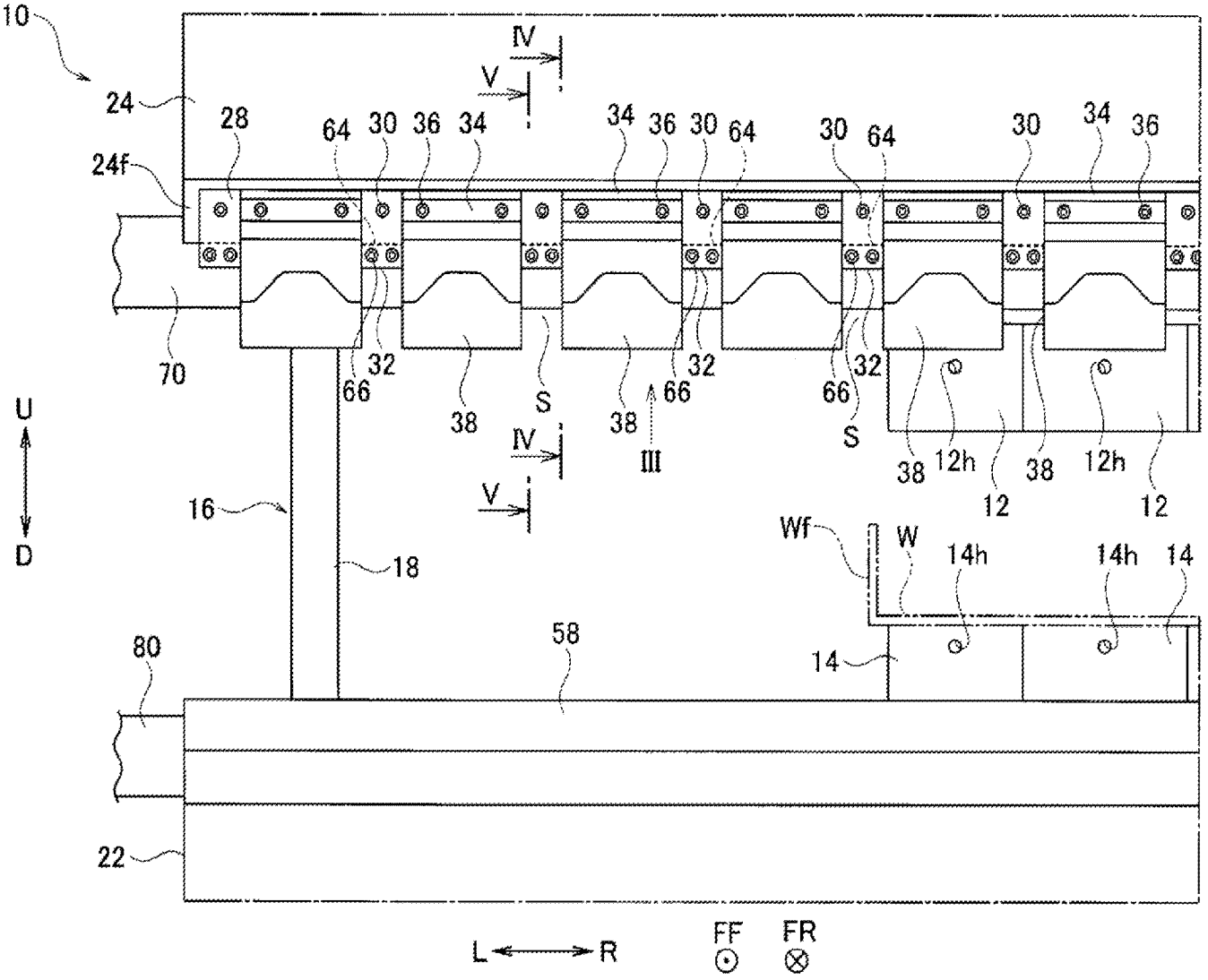
FIG. 2 is an enlarged view of part II in FIG. 1.

As shown in FIG. 1 and FIG. 2, a press brake 10 according to a first embodiment is a processing machine that performs bending of a plate-shaped workpiece (sheet metal) W by cooperation of an automatically changeable upper tool (punch) 12 and a lower tool (die) 14. An engagement hole 12*h* is formed through a center of the upper tool 12 in the left-right direction (lateral direction). In a shank 12*s* (see FIG. 4) of the upper tool 12, an anti-drop groove 12*g* (see FIG. 4) is formed along the left-right direction. An engagement hole 14*h* is formed through a center of the lower tool 14 in the left-right direction.

The press brake 10 includes a main frame 16. The main frame 16 includes a pair of side plates 18 separated from and opposed to each other in the left-right direction, and a plurality of beam members 20 (only one is shown in the drawing) coupling the pair of side plates 18. In a lower part of the main frame 16, a lower table 22 extending in the left-right direction is provided. In an upper part of the main frame 16, an upper table 24 extending in the left-right direction is vertically movably provided. In each of upper parts of the side plates 18, a hydraulic cylinder 26 is provided as a vertically-driving actuator that vertically moves the upper table 24 relative to the main frame 16. Note that instead of configuring the upper table 24 to be vertically movable, the lower table 22 may be configured to be vertically movable. As the vertically-driving actuator, a servo motor may be used in place of the hydraulic cylinder 26.

As shown in FIG. 2 to FIG. 6, on a lower end side of a front surface of the upper table 24, a machining-finished surface 24*f* is formed along the left-right direction. A plate-shaped attachment base 28 extending in the left-right direction is attached to the machining-finished surface 24*f* of the upper table 24 with a plurality of attachment bolts 30. Each attachment bolt 30 penetrates a bolt hole 28*h* formed in the attachment base 28. The attachment base 28 has a front surface and a back surface that are finished by machining. On a lower end side of the attachment base 28, a plurality of protruding tabs (protrusions) 32 protruding downward are formed at even intervals in the left-right direction. Note that the plurality of protruding tabs 32 may only be arranged at intervals in the left-right direction, and do not have to be arranged at even intervals.

A plurality of fixture plates (fastening plates) 34 are attached to the front surface of the attachment base 28 at intervals in the left-right direction with attachment bolts 36. That is, on the front surface of the upper table 24, the fixture plates 34 are arranged at intervals in the left-right direction via the attachment base 28 and the attachment bolts 36. At a lower end of a back surface of each fixture plate 34, a pawl 34*c* is formed along the left-right direction. Each attachment bolt 36 penetrates a bolt hole 28*v* formed in the attachment base 28.

On a lower end side of the upper table 24, upper tool holders 38 removably holding the upper tool 12 are arranged at intervals in the left-right direction. Each upper tool holder 38 includes an attachment plate 40 to be pressed onto the front surface of the upper table 24 with the fixture plate 34. That is, on the lower end side of the upper table 24, the upper tool holders 38 are arranged at intervals in the left-right direction via the fixture plates 34. Further, each upper tool holder 38 is disposed between the protruding tabs 32 adjacent to each other in the left-right direction in the front surface of the attachment base 28. The upper tool holder 38 includes, for example, a configuration disclosed in Patent Literature 2 described above. The configuration of the upper tool holder 38 will be briefly described hereinafter.

As shown in FIG. 2 to FIG. 5, in an upper part of a front surface of the attachment plate 40, an engagement groove

40*g* to be engaged with the pawl 34*c* of each fixture plate 34 is formed. A holder main body (intermediate plate) 42 is attached to a lower part of a rear surface of the attachment plate 40 with a plurality of attachment bolts (not shown). The holder main body 42 is located on a lower side of the upper table 24. That is, the holder main body 42 is disposed on the lower side of the upper table 24 with the attachment plate 40. An upper surface of the holder main body 42 is formed as a tilted surface 42*f* tilted in the front-rear direction.

A wedge member 44 is disposed between the holder main body 42 and the upper table 24, and disposed at position adjustable relative to the holder main body 42 in the front-rear direction. A lower surface of the wedge member 44 is formed as a tilted surface 44*f* tilted in the front-rear direction. The tilted surface 44*f* comes in sliding contact with the tilted surface 42*f* of the holder main body 42. In a center of the attachment plate 40 in the left-right direction, a push bolt 46 for pushing the wedge member 44 rearward is disposed. On right and left sides of the push bolt 46 of the attachment plate 40, pull bolts 48 for pulling the wedge member 44 forward are arranged, respectively.

A clamp plate 50 configured to press the shank 12*s* of the upper tool 12 onto the holder main body 42 is swingably attached to a front surface of the holder main body 42 with a plurality of support shafts 52. A clamp plate 50 configured to press the shank 12*s* onto the holder main body 42 is also swingably attached to a back surface of the holder main body 42 with a plurality of support shafts 52. On a lower end side of each clamp plate 50, a hook member 54 engageable in the anti-drop groove 12*g* of the upper tool 12 is formed. Also, in the holder main body 42, a clamp plate cylinder (not shown) for a pressing operation of a pair of clamp plates 50 is disposed. A spring 56 that urges each clamp plate 50 in a release direction of the pressing operation is interposed between the holder main body 42 and each clamp plate 50.

Figure 3:
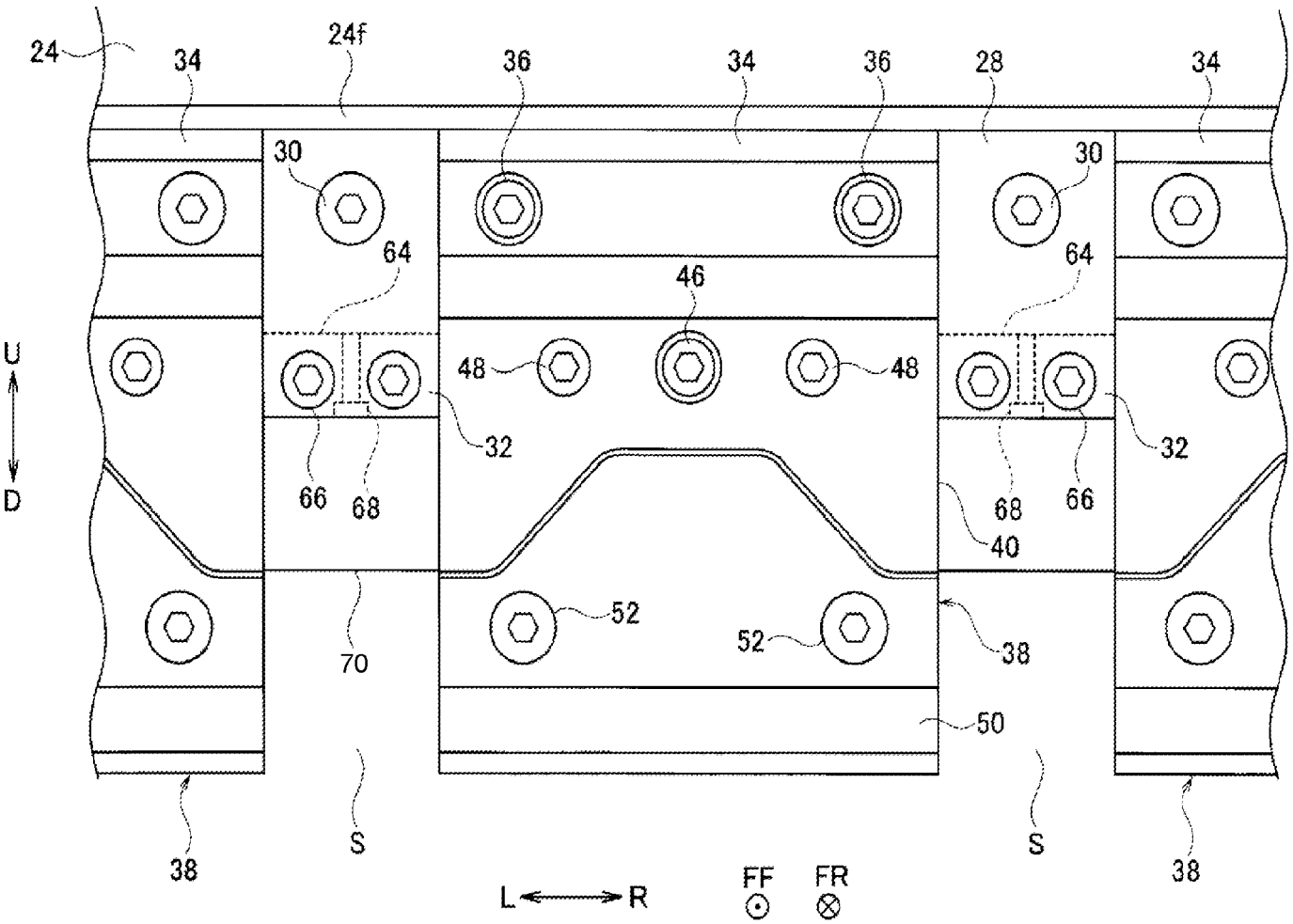
FIG. 3 is an enlarged view of part III in FIG. 2.
Figure 6:
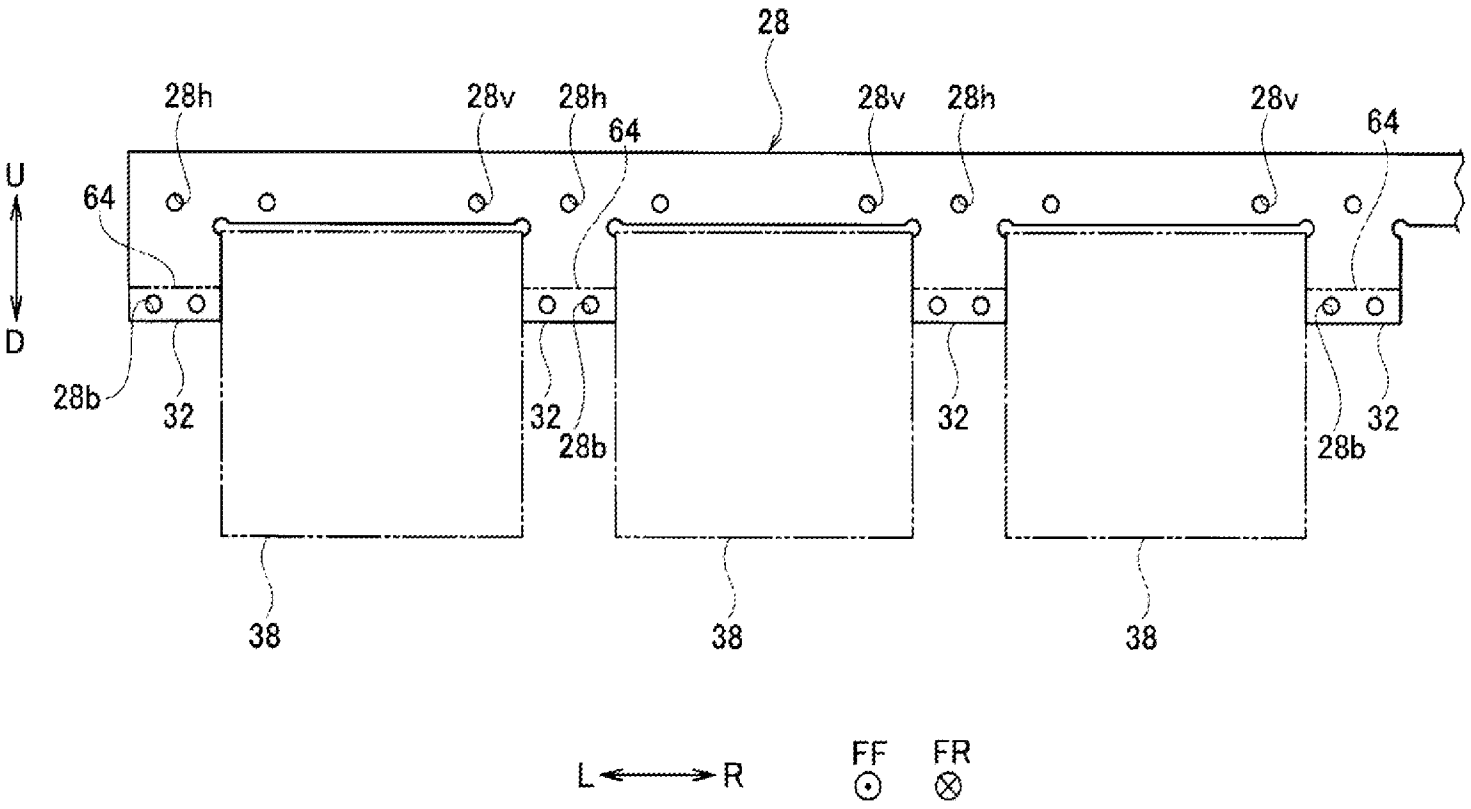
FIG. 6 is a partial front view showing an attachment base.

As shown in FIG. 2, FIG. 3 and FIG. 6, in the present embodiment, the attachment plate 40 in each upper tool holder 38 is interposed between the protruding tabs 32 adjacent to each other in the left-right direction. Each protruding tab 32 of the attachment base 28 is a first regulating member that comes in contact with a side surface of the attachment plate 40 to regulate side misalignment (positional shift in the left-right direction) of the upper tool holder 38. That is, the protruding tabs 32 (first regulating members) are arranged on opposite left and right sides of each attachment plate 40 in the front surface of the upper table 24, respectively. Also, an escape space S for avoiding interference of a side flange Wf with a part (upper tool holder 38 or the like) of the press brake 10 due to folding-up of the workpiece W is formed between the upper tool holders 38 adjacent to each other. Note that FIG. 6 shows the upper tool holders 38 and connecting members 64 with dashed lines.

As shown in FIG. 1 and FIG. 2, a lower tool holder 58 removably holding the lower tool 14 is provided at an upper end of the lower table 22. The lower tool holder 58 extends in the left-right direction. The lower tool holder 58 includes, for example, a configuration disclosed in Patent Literature 1 described above.

As shown in FIG. 1, the press brake 10 is equipped with an auto tool changer (ATC) 60 for automatically changing the upper tool 12 and the lower tool 14. On one side (right side) of the main frame 16 of the ATC 60 in the left-right direction, a tool storage 62 that stores a plurality of upper tools 12 and a plurality of lower tools 14 is disposed. The tool storage 62 includes, for example, a configuration disclosed in Patent Literatures 1, 3 and 4 described above. The tool storage 62 includes, in an upper part, a plurality of upper stockers (not shown) holding the plurality of upper tools 12. The selected upper stocker is positioned at an upper tool exchange position located on a side of the upper tool holder 38. Also, the tool storage 62 includes, in a lower part, a plurality of lower stockers (not shown) holding a plurality of lower tools 14. The selected lower stocker is positioned at a lower tool exchange position located on a side of the lower tool holder 58.

As shown in FIG. 2 to FIG. 6, the rectangular plate-shaped connecting members 64 are attached to back surfaces of the respective protruding tabs 32 of the attachment base 28 with a plurality of attachment bolts 66. Each attachment bolt 66 penetrates a bolt hole 28*b* formed in the attachment base 28. Each connecting member 64 on a distal end side (rear end side) is located on a back side of the upper table 24. Each connecting member 64 has a base-end face (front end face) and a distal-end face (rear end face) finished by machining. To prevent deflection of the connecting members 64, the connecting members 64 are coupled to a lower end face of the upper table 24 with a plurality of coupling bolts 68. Each connecting member 64 is a second regulating member that comes in contact with a side surface of the holder main body 42 to regulate side misalignment of the upper tool holder 38. That is, the connecting members 64 (second regulating members) are arranged on opposite left and right sides of the upper tool holder 38 on the lower end side of the upper table 24, respectively.

Figure 4:
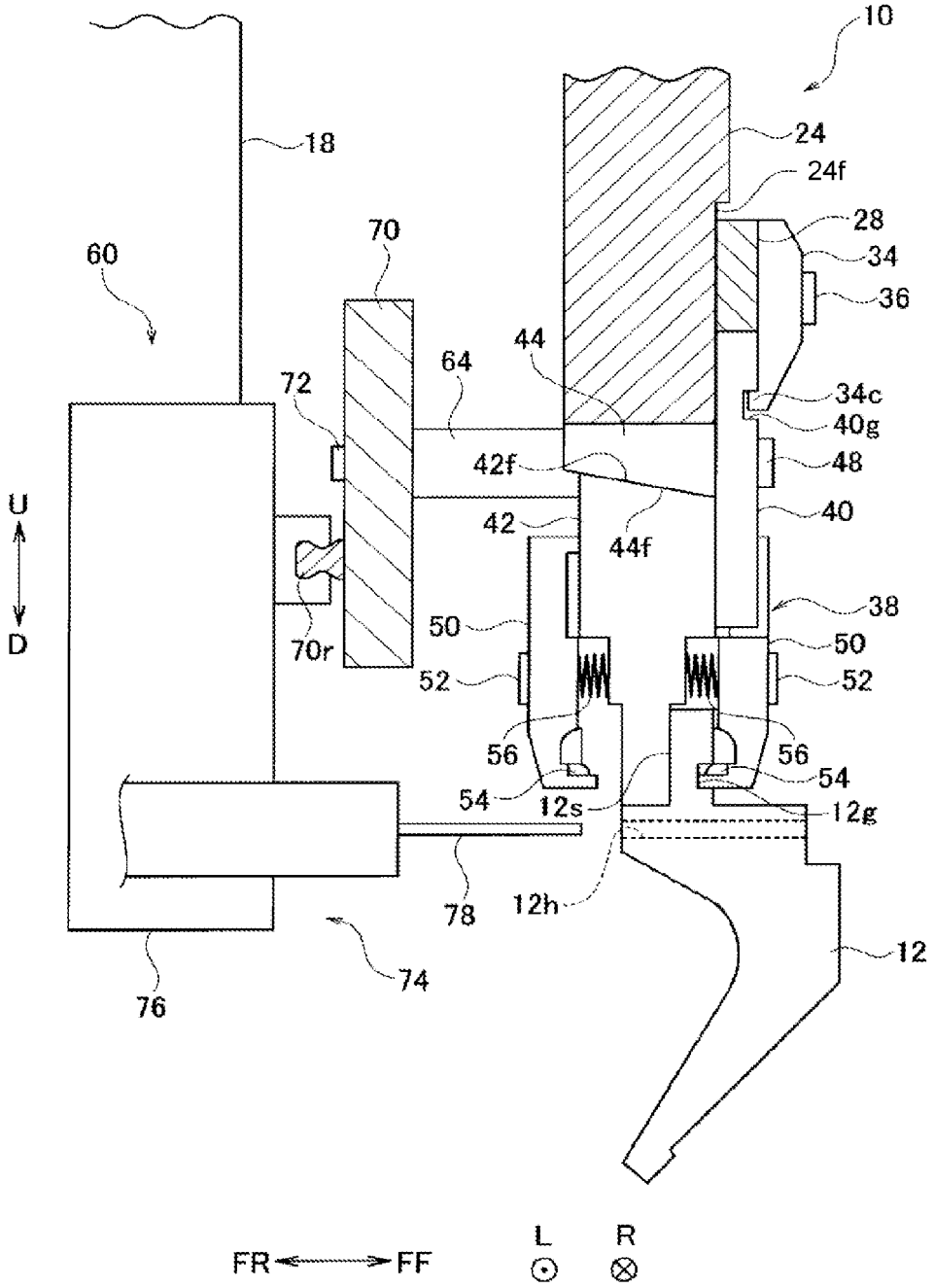
FIG. 4 is a cross-sectional view along the IV-IV line in FIG. 2.
Figure 5:
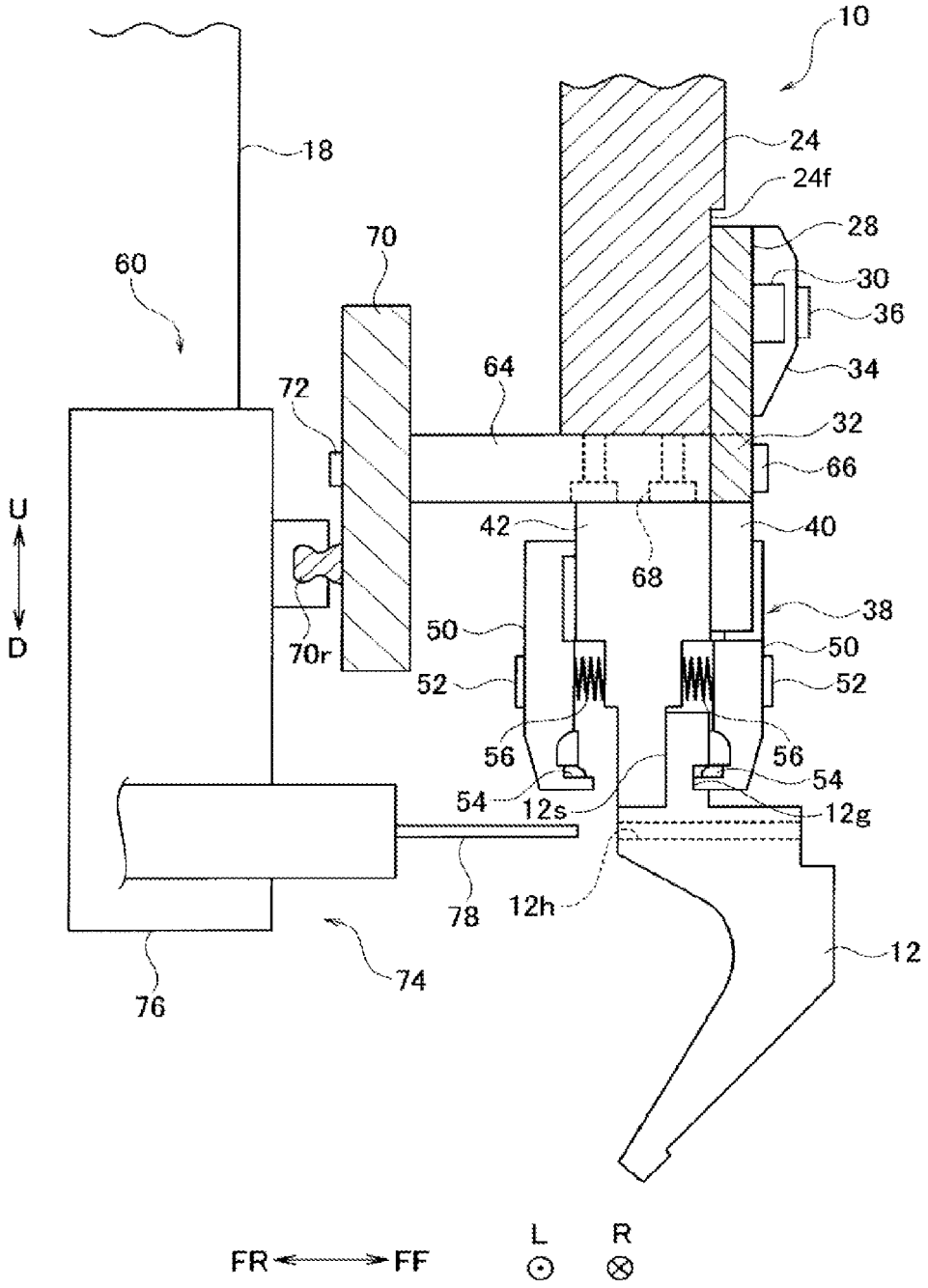
FIG. 5 is a cross-sectional view along the V-V line in FIG. 2.

As shown in FIG. 1, FIG. 4 and FIG. 5, an upper guide member 70 extending in the left-right direction is integrally coupled to a rear end face of the connecting member 64 with a coupling bolt 72. The upper guide member 70 has a left end protruding leftward from the upper table 24. The upper guide member 70 has a right end protruding rightward from the upper table 24, and overlapping with the tool storage 62. The upper guide member 70 includes, on a back surface, a rail 70*r* extending in the left-right direction. Also, on the rail 70*r*, a pair of upper tool changing units 74 for automatically changing the upper tool 12 are provided movably in the left-right direction. That is, the upper guide member 70 supports the pair of upper tool changing units 74 as moving bodies movably in the left-right direction on the back side of the upper table 24. Each upper tool changing unit 74 can remove the upper tool 12 from the upper tool holder 38 (or the upper stocker positioned at the upper tool exchange position) in the front-rear direction and left-right direction. Also, the upper tool changing unit 74 can attach the upper tool 12 to the upper tool holder 38 (or the upper stocker positioned at the upper tool exchange position) in the front-rear direction and left-right direction.

The upper tool changing unit 74 includes, for example, a configuration disclosed in Patent Literature 1 described above. The upper tool changing unit 74 includes an upper unit main body 76 provided movably in the left-right direction on the rail 70*r* of the upper guide member 70, and an upper tool retention member 78 provided in the upper unit main body 76. The upper tool retention member 78 is a rod-shaped or hook-shaped member engageable in the engagement hole 12*h* of the upper tool 12. The upper tool retention member 78 is configured to be movable in the front-rear direction and up-down direction relative to the upper unit main body 76. Note that the upper tool retention member 78 does not have to be movable vertically to the upper unit main body 76. A changing operation by the upper tool changing units 74 is not described.

As shown in FIG. 1, a lower guide member 80 extending in the left-right direction is attached to a back surface of the lower tool holder 58. The lower guide member 80 has a left end protruding leftward from the lower table 22. The lower guide member 80 has a right end protruding rightward from the lower table 22, and overlapping with a tool storage 62 side. In the lower guide member 80, a pair of lower tool changing units 82 for automatically changing the lower tool 14 are provided movably in the left-right direction. Each lower tool changing unit 82 can remove the lower tool 14 from the lower tool holder 58 (or the lower stocker positioned at the lower tool exchange position) in the front-rear direction and left-right direction. Also, the lower tool changing unit 82 can attach the lower tool 14 to the lower tool holder 58 (or the lower stocker positioned at the lower tool exchange position) in the front-rear direction and left-right direction.

The lower tool changing unit 82 includes, for example, a configuration disclosed in Patent Literature 1 described above. The lower tool changing unit 82 includes a lower unit main body 84 provided movably in the left-right direction in the lower guide member 80, and a lower tool retention member 86 provided in the lower unit main body 84. The lower tool retention member 86 is a rod-shaped or hook-shaped member engageable in the engagement hole 14*h* of the lower tool 14. The lower tool retention member 86 is configured to be movable in the front-rear direction and up-down direction relative to the lower unit main body 84. Note that a changing operation by the lower tool changing units 82 is not described.

Subsequently, description will be made as to effects of the present embodiment.

In the present embodiment, the attachment base 28 is provided on the lower end side of the front surface of the upper table 24, and the upper tool holder 38 is disposed between the protruding tabs 32 adjacent to each other in the left-right direction in the front surface of the attachment base 28. That is, the upper tool holder 38 is attached to the lower end side of the front surface of the upper table 24 via the attachment base 28. The attachment surface of the upper tool holder 38 is the front surface of the attachment base 28, and the attachment reference surface of the upper tool holder 38 in the front-rear direction is the machining-finished surface 24*f* of the upper table 24 on the lower end side of the front surface.

Further, in the present embodiment, the connecting member 64 is attached to the back surface of each protruding tab 32 of the attachment base 28, and the upper guide member 70 is integrally coupled to the distal-end face of each connecting member 64. That is, the upper guide member 70 is attached to the lower end side of the front surface of the upper table 24 via the connecting member 64 and the attachment base 28. The attachment surface of the upper guide member 70 is the distal-end face of the connecting member 64, and hence the attachment reference surface of the upper guide member 70 in the front-rear direction is the machining-finished surface 24*f* of the upper table 24 on the lower end side of the front surface via the connecting member 64.

Therefore, according to the present embodiment, the attachment reference surface of the general-purpose upper tool holder and the attachment reference surface of the upper guide member can be the same. Also, according to the present embodiment, in the case of equipping the stand-alone press brake 10 with the upper tool changing unit 74 as the moving body, parallelism of the upper guide member 70 to the upper tool holders 38 can be kept with high accuracy, and reliability of the changing operation by the upper tool changing unit 74 can be sufficiently secured.

Further, in the present embodiment, the protruding tabs 32 (first regulating members) are arranged on the opposite left and right sides of the attachment plate 40 in the front surface of the upper table 24, respectively. The connecting members 64 (second regulating members) are arranged on the opposite left and right sides of each upper tool holder 38 on the lower end side of the upper table 24, respectively. Therefore, even when the deflections of the upper table 24 and the lower table 22 increase due to the bending load during the bending of the workpiece W, the protruding tabs 32 and the connecting members 64 can regulate (prevent) the side misalignment of the upper tool holder 38 to the upper table 24. As a result, the reliability of the changing operation by the upper tool changing unit 74 can be more sufficiently secured. Also, bending defect can be prevented, and the bending can be performed with high accuracy and stability, while avoiding the interference of the side flange Wf with the upper tool holder 38 or the like.

Second Embodiment

Figure 7:
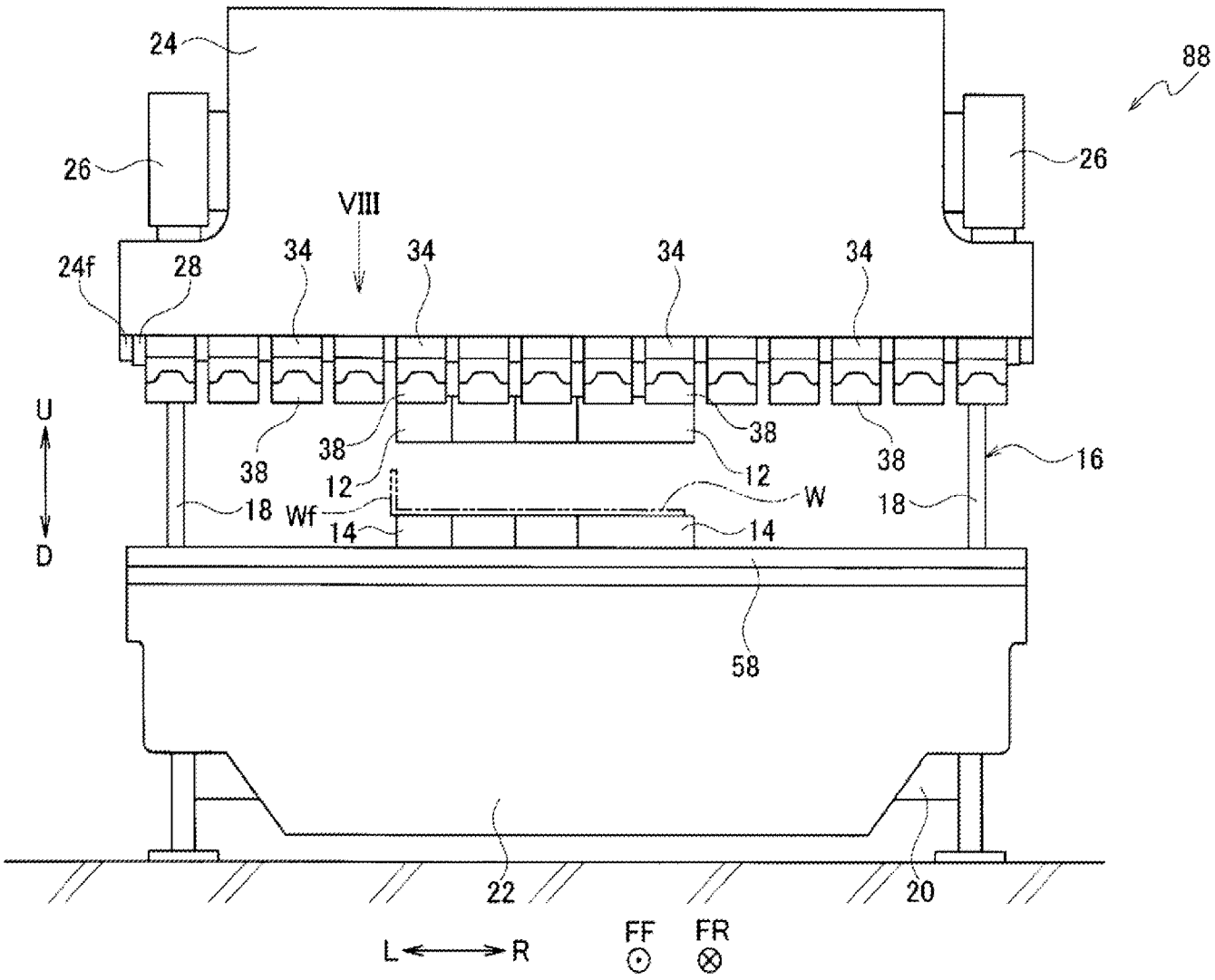
FIG. 7 is a schematic front view showing a press brake according to a second embodiment.
Figure 8:
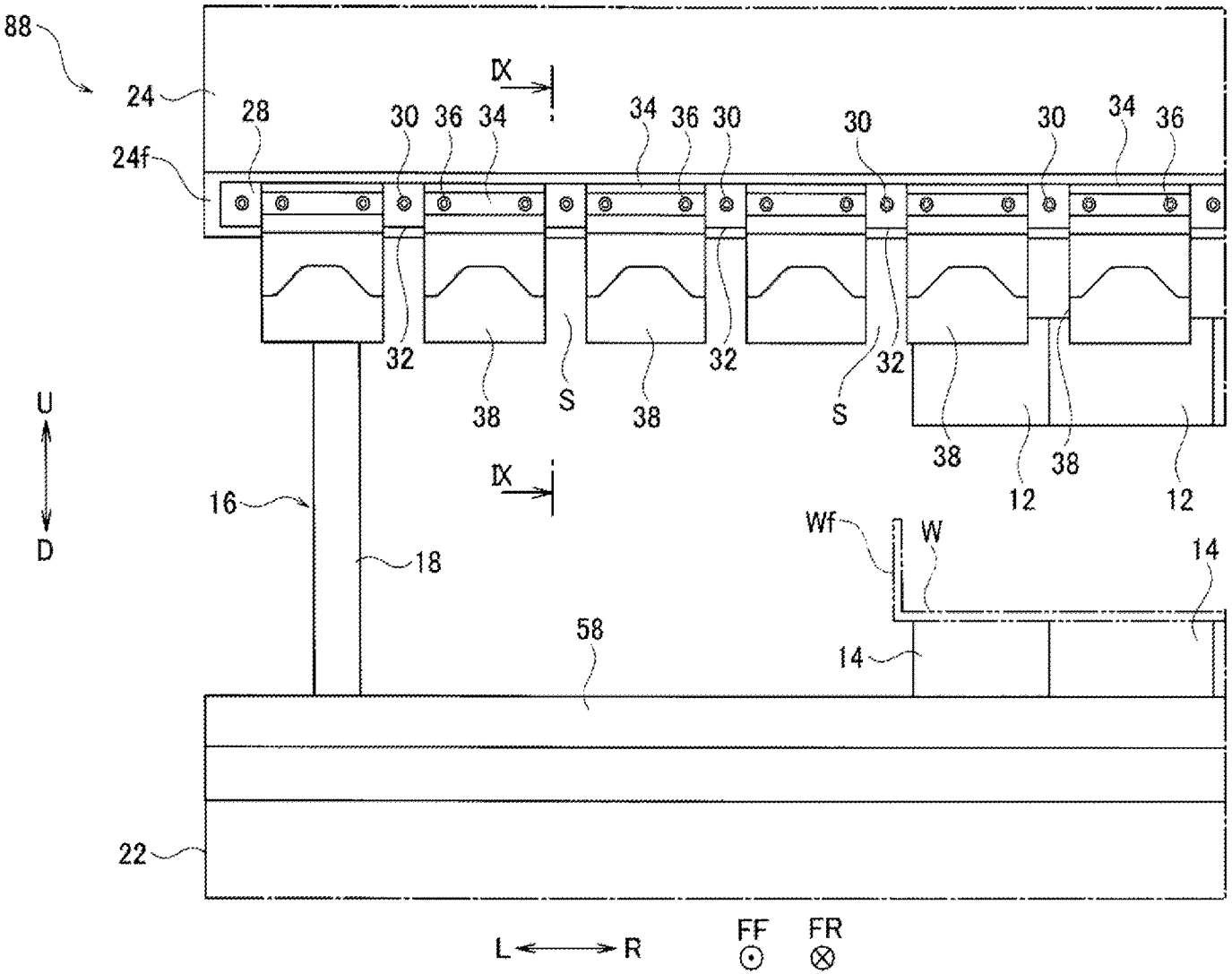
FIG. 8 is an enlarged view of part VIII in FIG. 7.
Figure 9:
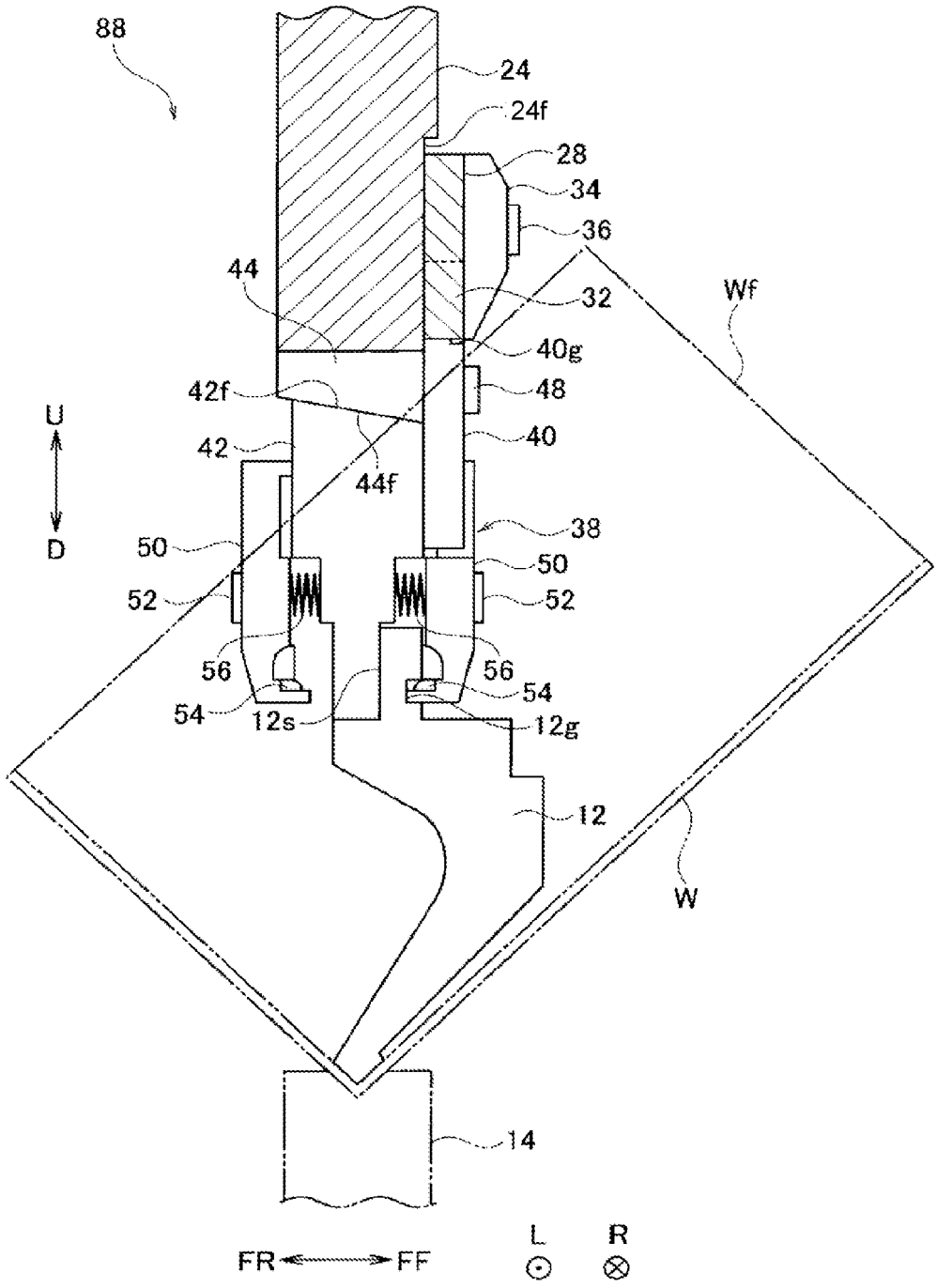
FIG. 9 is an enlarged cross-sectional view along the IX-IX line in FIG. 8.

As shown in FIG. 7 to FIG. 9, a press brake 88 according to a second embodiment is a processing machine that performs bending of a plate-shaped workpiece (sheet metal) W by cooperation of an upper tool 12 and a lower tool 14. In the present embodiment, an engagement hole 12*h* (see FIG. 2) is not formed in the upper tool 12, but the engagement hole 12*h* may be formed. An engagement hole 14*h* (see FIG. 2) is not formed in the lower tool 14, but the engagement hole 14*h* may be formed.

The press brake 88 includes a configuration similar to the configuration of the press brake 10 (see FIG. 1) except that the press brake is not equipped with an ATC 60 (see FIG. 1). Hereinafter, description will be made only as to a configuration of the press brake 88 that is different from the configuration of the press brake 10. Note that components of the press brake 88 corresponding to the components of the press brake 10 are denoted with the same reference signs, and the components are not described in detail.

A lower end face of each protruding tab (protrusion) 32 of an attachment base 28 is positioned higher than a lower end face of an upper table 24. A connecting member (see FIG. 5) is not provided on a back surface of the protruding tab 32. The protruding tab 32 is a regulating member that comes in contact with a side surface of an attachment plate 40 to regulate side misalignment (positional shift in a left-right direction) of each upper tool holder 38. That is, the protruding tabs 32 (regulating members) are arranged on opposite left and right sides of each attachment plate 40 in a front surface of the upper table 24, respectively. Note that the lower end face of the protruding tab 32 may be positioned as high as the lower end face of the upper table 24 instead of being positioned higher than the lower end face of the upper table 24.

The upper tool holder 38 includes, for example, a mechanical type configuration disclosed in Patent Literature 5 described above. A lower tool holder 58 includes, for example, a mechanical type configuration disclosed in Patent Literature 6 described above.

Subsequently, description will be made as to effects of the present embodiment.

The protruding tabs 32 (regulating members) are arranged on the opposite left and right sides of each attachment plate 40 in the front surface of the upper table 24, respectively. Therefore, even when deflections of the upper table 24 and a lower table 22 increase due to bending load during the bending of the workpiece W, the protruding tabs 32 can regulate (prevent) side misalignment of the upper tool holder 38 to the upper table 24. As a result, bending defect can be prevented, and the bending of the workpiece W can be performed with high accuracy and stability, while avoiding interference of a side flange Wf with the upper tool holder 38 or the like.

Also, since the lower end face of each protruding tab 32 is positioned higher than the lower end face of the upper table 24, a height of the side flange Wf is not restricted by the protruding tab 32 as the regulating member, and a degree of freedom in bending of the workpiece W can be sufficiently secured. That is, the degree of freedom in bending of the workpiece W can be sufficiently secured, and additionally, the bending of the workpiece W can be performed with high accuracy and stability. Even when the lower end face of the protruding tab 32 is positioned as high as the lower end face of the upper table 24, the degree of freedom in bending can be sufficiently secured. If the lower end face of the protruding tab 32 is positioned lower than the lower end face of the upper table 24, the degree of freedom in bending cannot be secured.

First Modification

Figure 10:
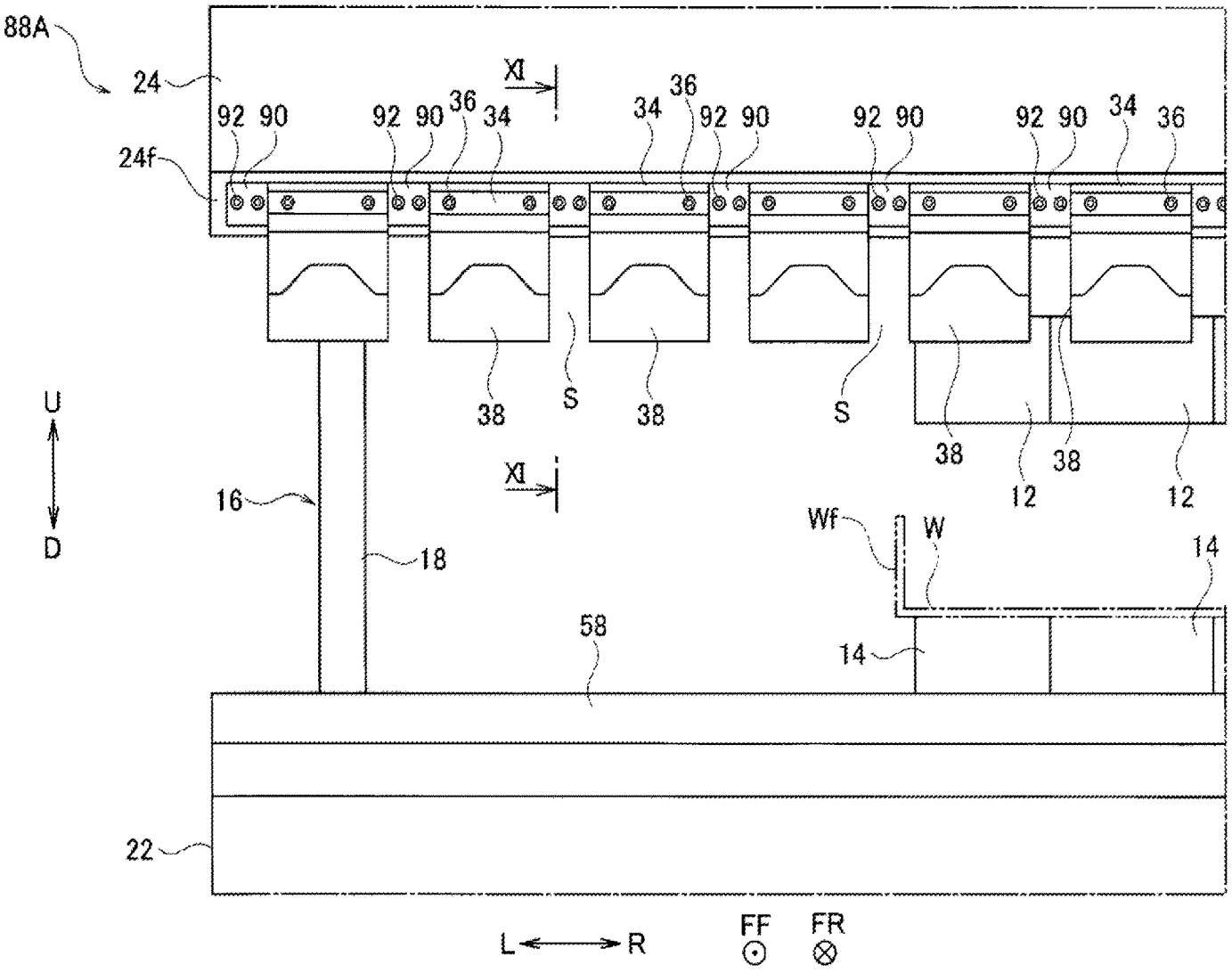
FIG. 10 is a partial front view showing a press brake according to a first modification of the second embodiment.
Figure 11:
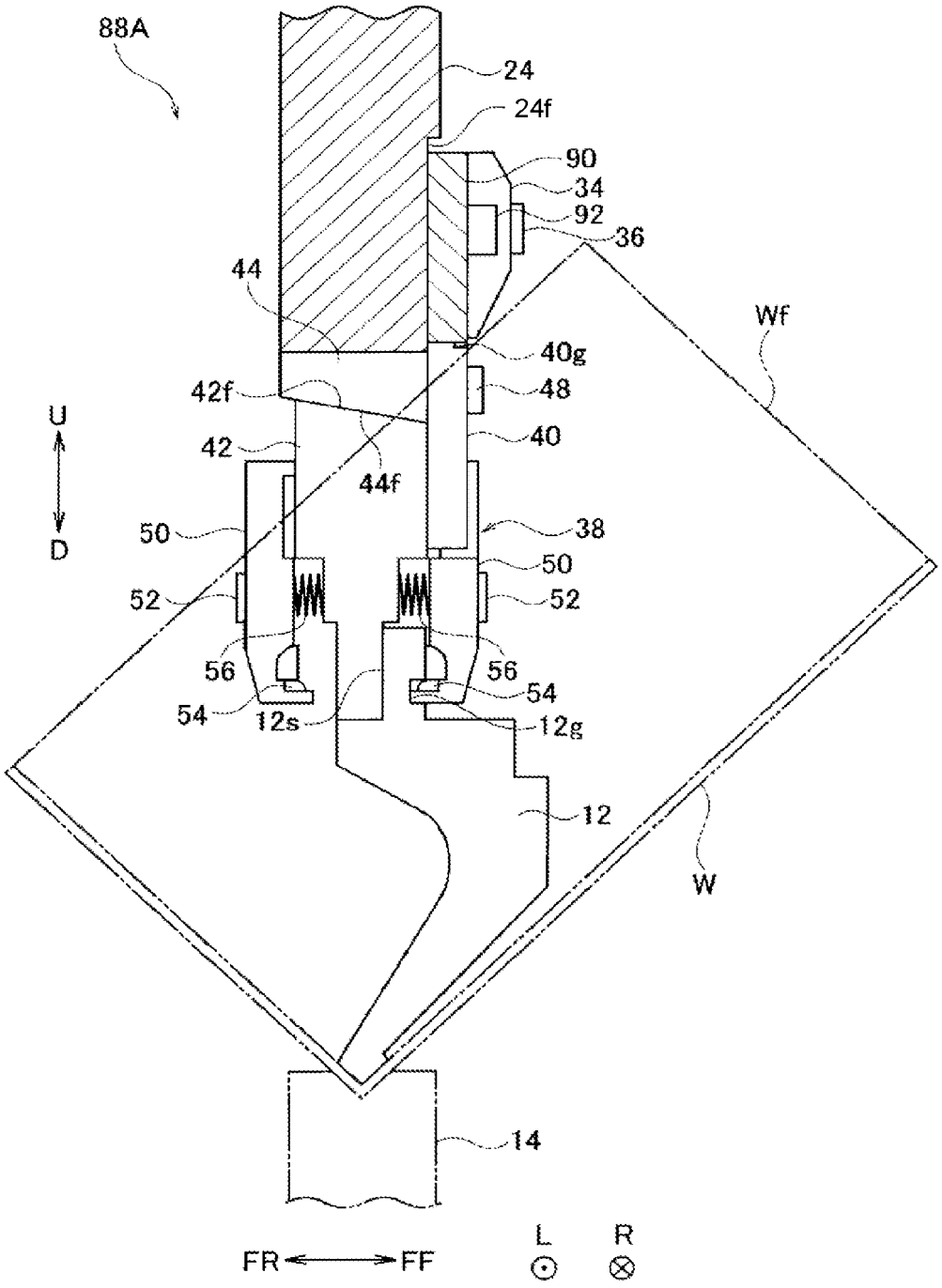
FIG. 11 is an enlarged cross-sectional view along the XI-XI line in FIG. 10.

As shown in FIG. 10 and FIG. 11, a press brake 88A according to a first modification of the second embodiment includes a configuration similar to the press brake 88 (see FIG. 8). Hereinafter, description will be made only as to a configuration of the press brake 88A that is different from the configuration of the press brake 88. Note that components of the press brake 88A corresponding to the components of the press brake 88 are denoted with the same reference signs, and the components are not described in detail.

In the configuration of the press brake 88A, the attachment base 28 (see FIG. 8) is omitted. A plurality of fixture plates 34 are attached to a lower end side of a front surface of an upper table 24 at intervals in a left-right direction with attachment bolts 36. The fixture plates 34 are fixed directly to the front surface of the upper table 24. (An upper part of each fixture plate 34 is thicker only as much as a thickness of the attachment base 28.)

Rectangular plate-shaped regulating members 90 are attached to opposite left and right sides of each upper tool holder 38 in the front surface of the upper table 24 with attachment bolts 92. Each regulating member 90 comes in contact with a side surface of an attachment plate 40 to regulate side misalignment (positional shift in a left-right direction) of the upper tool holder 38. A lower end face of the regulating member 90 is positioned higher than a lower end face of the upper table 24. Note that the lower end face of the regulating member 90 may be positioned as high as the lower end face of the upper table 24 instead of being positioned higher than the lower end face of the upper table 24.

Subsequently, description will be made as to effects of the present modification.

The regulating members 90 are arranged on the opposite left and right sides of each upper tool holder 38 in the front surface of the upper table 24, respectively. Therefore, even when deflections of the upper table 24 and a lower table 22 increase due to bending load during the bending of a workpiece W, the regulating members 90 can regulate side misalignment of the upper tool holder 38 to the upper table 24. As a result, bending defect can be prevented, and the bending of the workpiece W can be performed with high accuracy and stability, while avoiding interference of a side flange Wf with the upper tool holder 38 or the like.

Also, since the lower end face of each regulating member 90 is positioned higher than the lower end face of the upper table 24, a height of the side flange Wf is not restricted by the regulating member 90, and a degree of freedom in bending of the workpiece W can be sufficiently secured. That is, the degree of freedom in bending of the workpiece W can be sufficiently secured, and additionally, the bending of the workpiece W can be performed with high accuracy and stability in the same manner as in the aforementioned second embodiment. Even when the lower end face of the regulating member 90 is positioned as high as the lower end face of the upper table 24, the degree of freedom in bending can be sufficiently secured. If the lower end face of the regulating member 90 is positioned lower than the lower end face of the upper table 24, the degree of freedom in bending cannot be secured.

Second Modification

Figure 12:
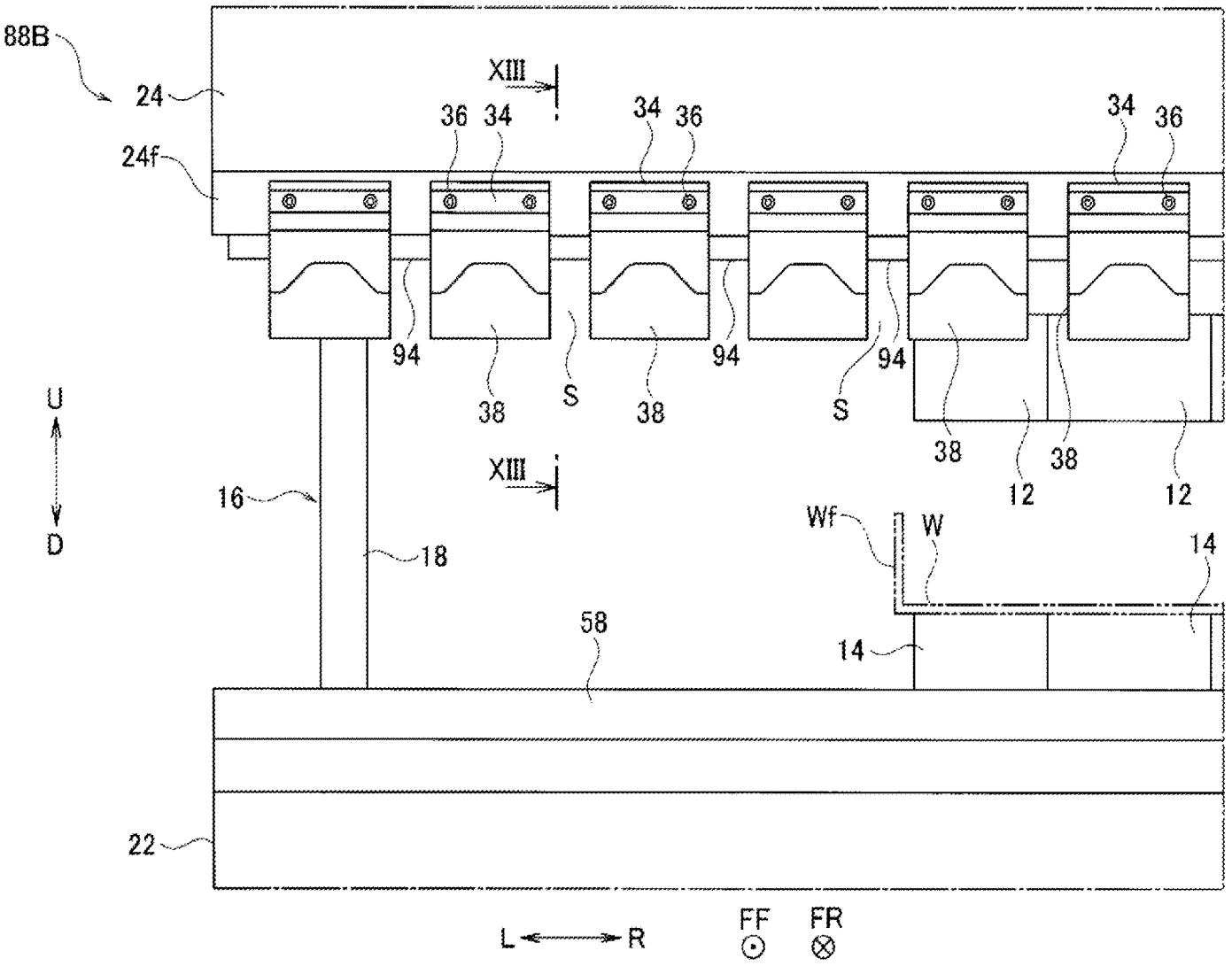
FIG. 12 is a partial front view showing a press brake according to a second modification of the second embodiment.
Figure 13:
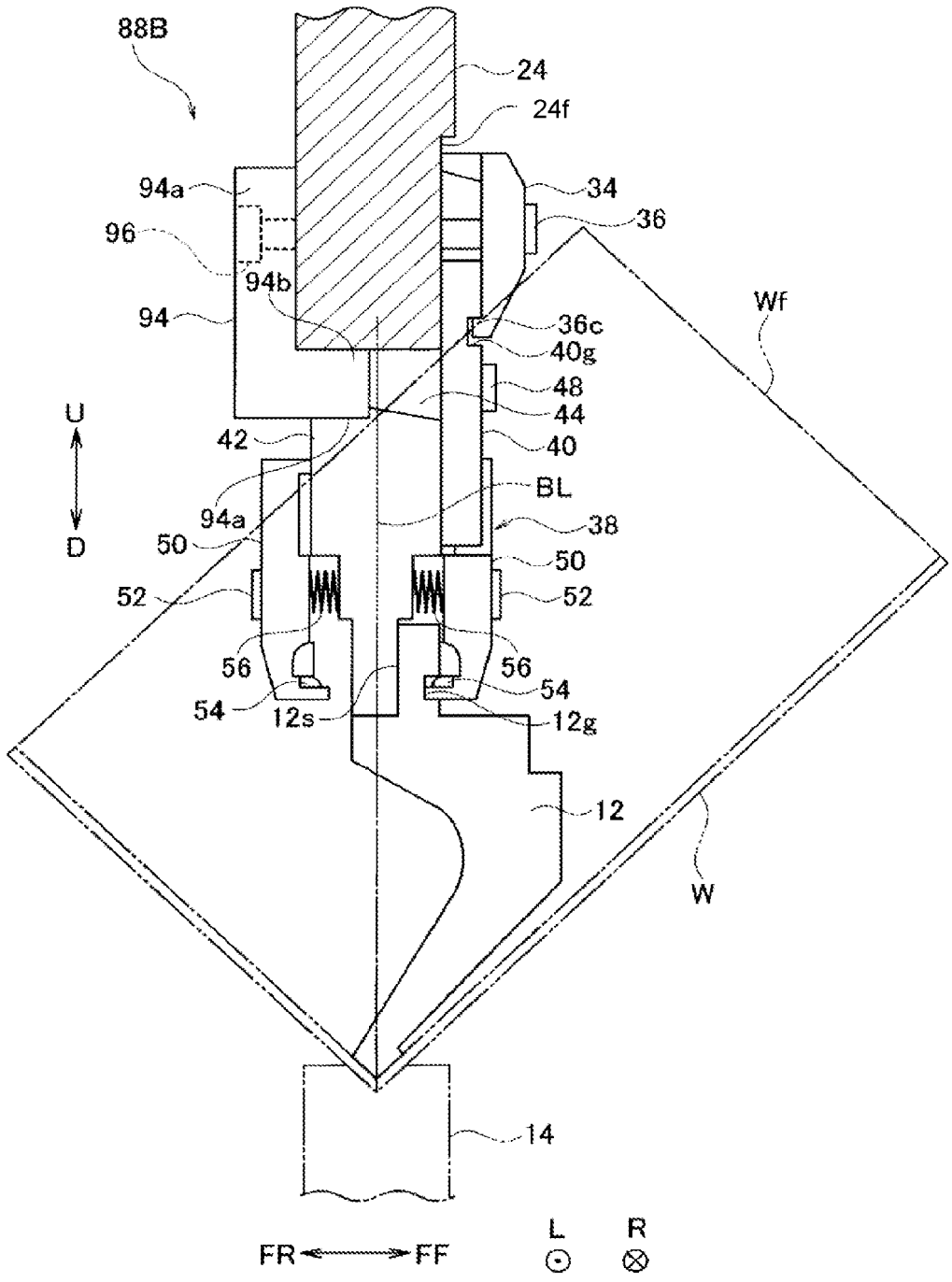
FIG. 13 is an enlarged cross-sectional view along the XIII-XIII line in FIG. 12.

As shown in FIG. 12 and FIG. 13, a press brake 88B according to a second modification of the second embodiment includes a configuration similar to the press brake 88 (see FIG. 8). Hereinafter, description will be made only as to a configuration of the press brake 88B that is different from the configuration of the press brake 88. Note that components of the press brake 88B corresponding to the components of the press brake 88 are denoted with the same reference signs, and the components are not described in detail.

In the configuration of the press brake 88B, the attachment base 28 (see FIG. 8) is omitted. A plurality of fixture plates 34 are attached to a lower end side of a front surface of an upper table 24 at intervals in a left-right direction with attachment bolts 36. The fixture plates 34 are fixed directly to the front surface of the upper table 24. (An upper part of each fixture plate 34 is thicker only as much as a thickness of the attachment base 28.)

Further, L-shaped regulating members 94 are attached on opposite left and right sides of each upper tool holder 38 on a lower end side of a back surface of the upper table 24 with attachment bolts 96. Each regulating member 94 comes in contact with a side surface of a wedge member 44 to regulate side misalignment (positional shift in the left-right direction) of each upper tool holder 38. The regulating member 94 includes a vertical part 94*a* fixed to the back surface of the upper table 24 with the attachment bolt 96, and a horizontal part 94*b* protruding forward from a lower end of the vertical part 94*a*. A front (front surface) of the horizontal part 94*b* of the regulating member 94 is located behind a pressurizing center position BL.

Subsequently, description will be made as to operations and effects of the present modification.

The regulating members 94 are arranged on the opposite left and right sides of each upper tool holder 38 on the lower end side of the back surface of the upper table 24, respectively. Therefore, even when deflections of the upper table 24 and a lower table 22 increase due to bending load during bending of a workpiece W, the regulating members 94 can regulate side misalignment of the upper tool holder 38 to the upper table 24. As a result, bending defect can be prevented, and the bending of the workpiece W can be performed with high accuracy and stability, while avoiding interference of a side flange Wf with the upper tool holder 38 or the like.

Also, since the front of the horizontal part 94*b* of the regulating member 94 is located behind the pressurizing center position BL, a height of the side flange Wf is not restricted by the regulating member 94, and a degree of freedom in bending of the workpiece W can be sufficiently secured. That is, the degree of freedom in bending of the workpiece W can be sufficiently secured, and additionally, the bending of the workpiece W can be performed with high accuracy and stability in the same manner as in the aforementioned second embodiment.

Entire contents of Japanese Patent Application No. 2019-87437 (filed on May 7, 2019) and Japanese Patent Application No. 2020-71715 (filed on Apr. 13, 2020) are incorporated in the present description by reference. The present invention is described above with reference to the embodiments of the present invention, but the present invention is not limited to the aforementioned embodiments. For example, a monitor camera or a bending indicator (bend angle detector) may be used as a moving body. The scope of the present invention is determined in light of claims.

The invention claimed is:

1. A press brake comprising:

an upper table extending in a left-right direction, perpendicular to a front-back direction, the upper table having a front surface and a back surface opposing each other in the front-back direction, a lower table extending in the left-right direction below the upper table in an up-down direction, the up-down direction being perpendicular to both the left-right direction and the front-back direction, the lower table having a front surface and a back surface opposing each other in the front-back direction, an attachment base provided on the front surface of the upper table, extending in the left-right direction, and including a front surface and a back surface opposing each other in the front-back direction, the attachment base further including a plurality of protruding tabs protruding downward in the up-down direction, the protruding tabs each having a front surface and a back surface opposing each other in the front-back direction, and being formed at intervals in the left-right direction;

an upper tool holder disposed between protruding tabs adjacent to each other in the left-right direction in the front surface of the attachment base, and holding an upper tool;

a plurality of connecting members, each of the plurality of connecting members attached to a respective back surface each of the plurality of protruding tabs, and comprising distal ends located beyond the back surface of the upper table in the front-back direction; and a guide member coupled to distal-end faces of the plurality of connecting members, extending in the left-right direction, and supporting a moving body movably in the left-right direction the guide member being beyond the back surface of the upper table in the front-back direction.

2. The press brake according to claim 1, wherein each of the protruding tabs is a first regulating member configured to regulate misalignment of the upper tool holder relative to the upper table in the left-right direction.

3. The press brake according to claim 1, wherein each of the connecting members is a second regulating member configured to regulate misalignment of the upper tool holder relative to the upper table in the left-right direction.

4. The press brake according to claim 1, wherein the moving body is an upper tool changing unit configured to automatically change the upper tool relative to the upper tool holder.

5. A press brake comprising:

an upper table extending in a left-right direction, perpendicular to a front-back direction, the upper table having a front surface and a back surface opposing each other in the front-back direction, a lower table extending in the left-right direction below the upper table in an up-down direction, the up-down direction being perpendicular to both the left-right direction and the front-back direction, the lower table having a front surface and a back surface opposing each other in the front-back direction, a plurality of fixture plates arranged at intervals in the left-right direction on the front surface of the upper table;

a plurality of upper tool holders arranged at intervals in the left-right direction on a lower end side of the upper table, including an attachment plate to be pressed onto the front surface of the upper table by each fixture plate, and holding an upper tool; and a regulating member fixed on each of opposite left and right sides, in the left-right direction, of each upper tool holder in the upper table by an attachment bolt, and configured to regulate misalignment of the upper tool holder relative to the upper table in the left-right direction.

6. The press brake according to claim 5, wherein each of the regulating members is provided on the front surface of the upper table, and each lower end face of the regulating member is positioned higher than a lower end face of the upper table or as high as the lower end face of the upper table in the up-down direction.

7. The press brake according to claim 5, wherein each of the regulating members is provided on a lower end side of the back surface of the upper table, and a front surface of each regulating member is located behind a pressurizing center position.

* * * * *